US006910929B2

(12) United States Patent
Yasuda et al.

(10) Patent No.: US 6,910,929 B2
(45) Date of Patent: Jun. 28, 2005

(54) OUTBOARD MOTOR

(75) Inventors: Toyoshi Yasuda, Wako (JP); Makoto Yazaki, Wako (JP); Yoshiyuki Matsuda, Wako (JP); Nobuo Haga, Wako (JP); Masayuki Ohsumi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/616,393

(22) Filed: Jul. 9, 2003

(65) Prior Publication Data

US 2004/0014377 A1 Jan. 22, 2004

(30) Foreign Application Priority Data

Jul. 18, 2002 (JP) ..... 2002-210154

(51) Int. Cl.[7] ..... B63H 21/36
(52) U.S. Cl. ..... 440/77
(58) Field of Search ..... 440/76, 77; 123/195 P

(56) References Cited

U.S. PATENT DOCUMENTS

| | | | | | |
|---|---|---|---|---|---|
| 2,676,559 | A | * | 4/1954 | Davies | 440/53 |
| 3,773,010 | A | * | 11/1973 | Elingsen | 440/77 |
| 4,600,396 | A | * | 7/1986 | Crane et al. | 440/77 |
| 4,723,927 | A | | 2/1988 | Walsh et al. | 440/77 |
| 5,080,618 | A | * | 1/1992 | Dunham et al. | 440/77 |
| 5,096,208 | A | | 3/1992 | Westberg | 277/181 |
| 5,487,687 | A | | 1/1996 | Idzikowski et al. | 440/77 |
| 5,560,247 | A | * | 10/1996 | Koishikawa et al. | 73/863.81 |
| 5,853,577 | A | | 12/1998 | Gizowski et al. | 210/168 |
| 5,873,756 | A | * | 2/1999 | Takayanagi | 440/77 |
| 5,951,341 | A | * | 9/1999 | Rinzaki et al. | 440/77 |
| 6,227,921 | B1 | * | 5/2001 | Feehan | 440/88 R |
| 6,419,535 | B1 | * | 7/2002 | Herrera | 440/77 |

FOREIGN PATENT DOCUMENTS

| | | |
|---|---|---|
| DE | 19940021 | 3/2001 |
| GB | 2255968 | 11/1992 |
| GB | 2364748 | 2/2002 |
| JP | 08099693 | 4/1996 |
| JP | 10184376 | 7/1998 |

* cited by examiner

*Primary Examiner*—Andrew D. Wright
(74) *Attorney, Agent, or Firm*—Adams & Wilks

(57) ABSTRACT

An outboard motor has an under cover forming a lower part of an engine room in which an engine is installed. The under cover has a pair of right and left cover members detachably connected together along opposing vertical edges thereof; an opening formed in at least one of the cover members for allowing access to the engine. The opening is vertically spaced from an upper edge of the under cover and extends contiguously from the vertical edge of the at least one cover member. A lid made of elastic material is attached to an outer surface of the under cover so as to close the opening of the under cover, the lid being elastically deformable to open and close the opening.

17 Claims, 12 Drawing Sheets

OUTBOARD MOTOR

FIELD OF THE INVENTION

The present invention relates generally to outboard motors, and more particularly to an outboard motor having a cover structure defining an engine room in which an engine is installed.

BACKGROUND OF THE INVENTION

An outboard motor is attached to the stern of a boat through a stern bracket, so that the outboard motor can swing in the lateral direction about a vertical axis and also tilt up and down about a horizontal axis. The outboard motor has an engine for driving a propulsion unit to propel the boat via a screw-propeller of the propulsion unit. The engine, engine accessories, a drive shaft, a gear mechanism and the screw-propeller are supported by a case means or assembly, and the engine is covered by a cover means or structure.

The cover structure defines an engine room in which the engine is installed. The cover structure includes a top cover that covers an upper part of the engine, and an under cover that covers both a lower part of the engine and a mount case on which the engine is mounted. The top cover is also called an engine cover. When the engine needs heavy maintenance, both the engine cover (top cover) and the under cover are removed. However, as for the light maintenance of the engine including inspection of ignition plug units, it is quite cumbersome for the operator to remove both the engine cover and the under cover and reassemble them together. To deal with this problem, several improvements have been proposed as disclosed, for example, in Japanese Patent Laid-open Publications (JP-A) Nos. HEI-10-184376 and HEI-8-99693.

The prior proposal shown in JP-A-HEI-10-184376 includes an under cover having a cutout recess formed at a rear end portion of the under cover. The cutout recess has a horizontally elongated U-shaped configuration for allowing access to an engine. A lid is removably connected to the under cover so as to close the U-shaped cutout recess. For attachment to the under cover, the lid has on its inside surface a plurality of mounting brackets connected by screws to corresponding retainers formed on an inner surface of the under cover along the U-shaped cutout recess. The U-shaped cutout recess allows access to the engine without removing the under cover and hence increases the efficiency of the maintenance work. However, since the screws used for attaching the lid to the under cover are disposed vertically and form joint portions on the interior side of the under cover, this arrangement still requires a top cover to be removed before the lid is detached from the under cover to open the U-shaped cutout recess.

Another prior proposal shown in JP-A-HEI-8-99693 comprises an under cover having circular holes formed in a rear end portion thereof. Through the circular holes, a tool is inserted into an engine room for tightening or loosening screws used for connecting a cylinder head to a cylinder block of an engine. The holes are normally closed by rubber plugs. The under cover has a dish-like structure and may be formed by a mold assembly that can be opened and closed in a vertical direction. The holes in the under cover are formed by slide cores associated with the mold assembly so as to be movable in a direction perpendicular to the opening and closing direction of the mold assembly. Due to the presence of the slide cores, the mold assembly as a whole is relatively complicated in construction and expensive to manufacture. Another problem is that the size of the holes is as small as possible because the holes lower the rigidity of the under cover.

SUMMARY OF THE INVENTION

It is, therefore, an objective of the present invention to provide an outboard motor having an engine cover structure which allows access to an engine part without removing the engine cover structure itself, thereby securing easy maintenance of the engine part.

According to an aspect of the present invention, there is provided an outboard motor comprising an engine and a cover structure defining an engine room in which the engine is installed. The cover structure comprises a top cover defining an upper part of the engine room and an under cover defining a lower part of the engine room, the top cover and the under cover being detachably connected together along horizontal edges thereof. The under cover comprises a pair of right and left cover members detachably connected together along opposing vertical edges thereof, an opening formed in at least one of the cover members for allowing access therethrough to the engine installed in the engine room, the opening being vertically spaced from the horizontal edge of the under cover and extending contiguously form the vertical edge of the at least one cover member, and a lid made of elastic material and attached to an outer surface of the under cover so as to close the opening of the under cover, the lid being elastically deformable to open and close the opening of the under cover.

Since the opening of the under cover is formed to extend from the vertical edge of at least one of the right and left cover member connected together, and since the lid is elastically deformable to open and close the opening, access to the engine inside the engine room is readily possible merely by elastically deforming the lid to open the opening without requiring detachment of the top cover from the under cover. This arrangement improves the maintainability of the engine. The lid normally closes the opening, thus making the under cover watertight in structure.

In one preferred form of the present invention, the engine is disposed with a crankshaft disposed vertically and a cylinder disposed horizontally, the engine having a removable spark plug unit associated with the cylinder, the spark plug unit being disposed opposite to the opening of the under cover. The spark plug unit can be readily checked or replaced through the opening.

The cover members of the under cover are formed of a synthetic resin material. The cover members can be easily produced by injection molding using a mold assembly that can be opened and closed in one direction. The opening of the under cover is contiguous from the vertical edge of each cover member, so that the opening can be formed at the same time the cover member is formed by injection molding, without requiring a slide core movable in a direction perpendicular to the opening and closing direction of the mold assembly. The mold assembly is relatively simple in construction and can be manufactured at a relatively low cost.

In one preferred form of the invention, each of the cover members has a cutout recess formed at the vertical edge thereof and forming, together with the cutout recess of another cover member, the opening of the under cover.

Preferably, the cover members are connected together by a plurality of joint portions arranged at intervals along the vertical edges of the cover members. Each of the joint portions is composed of a first engagement lug projecting horizontally from the vertical edge of one of the cover members, a second engagement lug projecting horizontally from the vertical edge of the other cover member, the first and second engagement lugs being fitted with each other in a front-and-rear direction of the under cover so as to form a half lap joint, and a screw fastener threaded into the first and second engagement lugs to join them together. The joint portions includes a first joint portion disposed between the horizontal edge of the under cover and the opening, and a second joint portion disposed below the opening.

By the first and second joint portions disposed on opposite sides of the opening in the vertical direction of the under cover, the under cover can possesses a relatively high rigidity even at a portion including the opening. Additionally, the first and second engagement lugs fitted together in the front-and-rear direction of the under cover can be readily fastened together by a screw that is threadedly driven from the exterior side of the under cover into the engagement lugs. This ensures that the cover members can be assembled and disassembled without removing the top cover from the under cover.

It is preferable that the first and second engagement lugs have sloped mating surfaces and are shaped into a reverse taper configuration. When the cover members are brought together, the first and second reverse taper engagement lugs engage or interlock with each other to thereby keep the cover members in a preassembled condition. This improves the assembling efficiency of the lower cover.

The cover members may have a reinforcement frame disposed on an inner surface of each cover member. The reinforcement frame includes a first horizontal reinforcement rib extending along an upper edge of each respective cover member, a plurality of vertical reinforcement ribs extending vertically downward from the first horizontal reinforcement rib, and a second horizontal reinforcement rib disposed immediately below the opening and extending from the vertical edge of each cover member to one of the vertical reinforcement ribs located near the vertical edge of the cover member. The first and second engagement lugs of the first joint portion are each formed integrally with the first horizontal reinforcement rib of a corresponding one of the cover members, and the first and second engagement lugs of the second joint portion are each formed integrally with the second horizontal reinforcement rib of a corresponding one of the cover members. By the reinforcement ribs disposed around the opening, the opening is allowed to have a relatively large size, which facilitates easy maintenance of the engine part.

It is preferable that the cover members are formed of a synthetic resin material, and the reinforcement frame is formed from a synthetic resin material and vibration-welded to each of the cover members.

The reinforcement frame may further include a third horizontal reinforcement rib disposed below the second horizontal reinforcement rib and extending parallel to the first horizontal reinforcement rib. The vertical reinforcement ribs extend between the first and third horizontal reinforcement ribs. The joint portions further include a third joint portion disposed below the second joint portion. The first and second engagement lugs of the third joint portion are each formed integrally with the third horizontal reinforcement rib of a corresponding one of the cover members. The outboard motor may comprise a mount case on which the engine is mounted, the mount case having a flange. In this instance, the third horizontal reinforcement rib has a longitudinal groove facing in a lateral inward direction of the under cover and receiving therein a peripheral edge of the flange of the mount case, the mount case forming a bottom wall of the engine room.

The lid preferably has a seal portion elastically fitted in the opening of the under cover. The seal portion may have a groove snugly receiving therein at least part of a peripheral edge of the opening of the under cover. The seal portion provides a hermetic seal between the lid and the cover members of the under cover at the portion including the opening. In order to provide an increased degree of waterproofness, the lid may further have a continuous seal lip extending around the seal portion and sealingly engaging the outer surface of the under cover.

In one preferred form of the invention, the lid has a first part which covers the opening of the under cover, and a second part integral with the first part and removably connected to the under cover. The first part is elastically bendable relative to the second part so as to open and close the opening of the under cover. This structure enables opening and closing of the opening without detaching the lid as a whole from the under cover. Preferably, the lid has a thin joint portion interconnecting the fist part and the second part and serving as a hinge.

The first part of the lid preferably has a seal portion elastically fitted in the opening of the under cover, and the second part of the lid has a plurality of locking projections removably fitted in a corresponding number of lid-mounting holes formed in the under cover. The first lid part is bent or folded relative to the second lid part so as to open the opening while the second lid part remains attached to the under cover by way of interlocking engagement between the locking projections and the lid-mounting holes.

The lid may further have a continuous seal lip extending around the seal portion and sealingly engaging the outer surface of the under cover. In this instance, the first part of the lid preferably has a plurality of locking projections removably fitted in a corresponding number of lid-mounting holes formed in the under cover. The locking projections of the first and second parts are arranged along a peripheral edge of the lid. The continuous seal lip is disposed inward of the locking projections and outward of the seal portion and extends along the peripheral edge of the lid without interference with the locking projections. This arrangement improve the degree of waterproofeness of the under cover at a portion including the opening.

Each of the cover members may have a cutout recess formed at the vertical edge thereof and forming, together with the cutout recess of another cover member, the opening of the under cover. The second part of the lid extends over and along the vertical edges of the cover members, so as to improve the waterproofness of the vertical edges forming mating surfaces of the cover members of the under cover.

BRIEF DESCRIPTION OF THE DRAWINGS

A preferred structural embodiment of the present invention will be described in detail herein below, by way of example only, with the reference to the accompanying drawings, in which.

DETAILED DESCRIPTION OF THE PREFERRED EMBODIMENT

Figure 1:
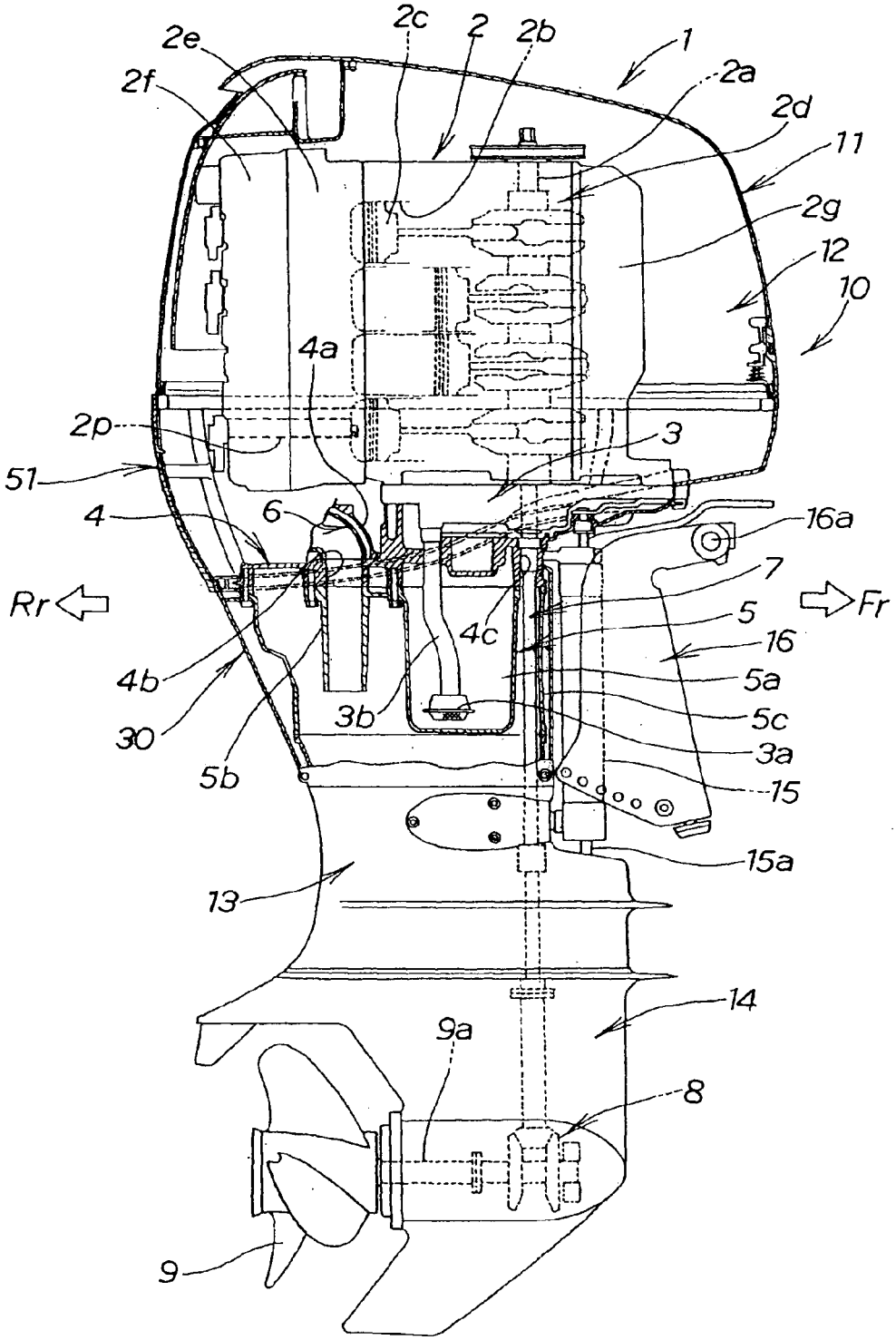
FIG. 1 is a schematic side view, with parts in cross section, of an outboard motor embodying the present invention.

Referring now to the drawings and FIG. 1 in particular, there is shown an outboard engine or motor 1 according to the present invention. The outboard motor 1 generally comprises an engine 2, a case means or structure 4, 5, 13 and 14 for supporting the engine 2 and related parts thereof, and a cover means or structure 10 defining an engine room 12 in which the engine 2 is installed. Throughout the specification, the terms "front" and "rear" are used with reference to the direction of movement of a boat on which the outboard motor 1 is mounted. Similarly, throughout the several views, reference characters "Fr" and "Rr" each associated with a profiled arrow are used to indicate "a forward direction" and "a rearward direction", respectively, when viewed from the direction of movement of the boat.

The engine 2 is a vertical multicylinder engine with a crankshaft 2*a* disposed vertically. The engine 2 in the illustrated embodiment has four cylinders 2*b* arranged in vertical juxtaposition and disposed horizontally so that the axis 2L (FIG. 2) of each cylinder 2*b* extends along a longitudinal centerline 1L (FIG. 2) of the outboard motor 1 in a substantially central region of the outboard motor 1. A piston 2*c* is slidably received in each cylinder 2*b*. The cylinders 2*b* are formed in a cylinder block 2*d*. The cylinder block 2*d* forms a central portion of the engine 2 when viewed in the front-and-rear direction (longitudinal direction) of the outboard motor 1. The engine 2 also has a cylinder head 2*e* disposed on a rear side of the cylinder block 2*d*, a cylinder head cover 2*f* disposed on a rear side of the cylinder head 2*e*, and a crankcase 2*g* disposed on a front side of the cylinder block 2*d*.

Figure 2:
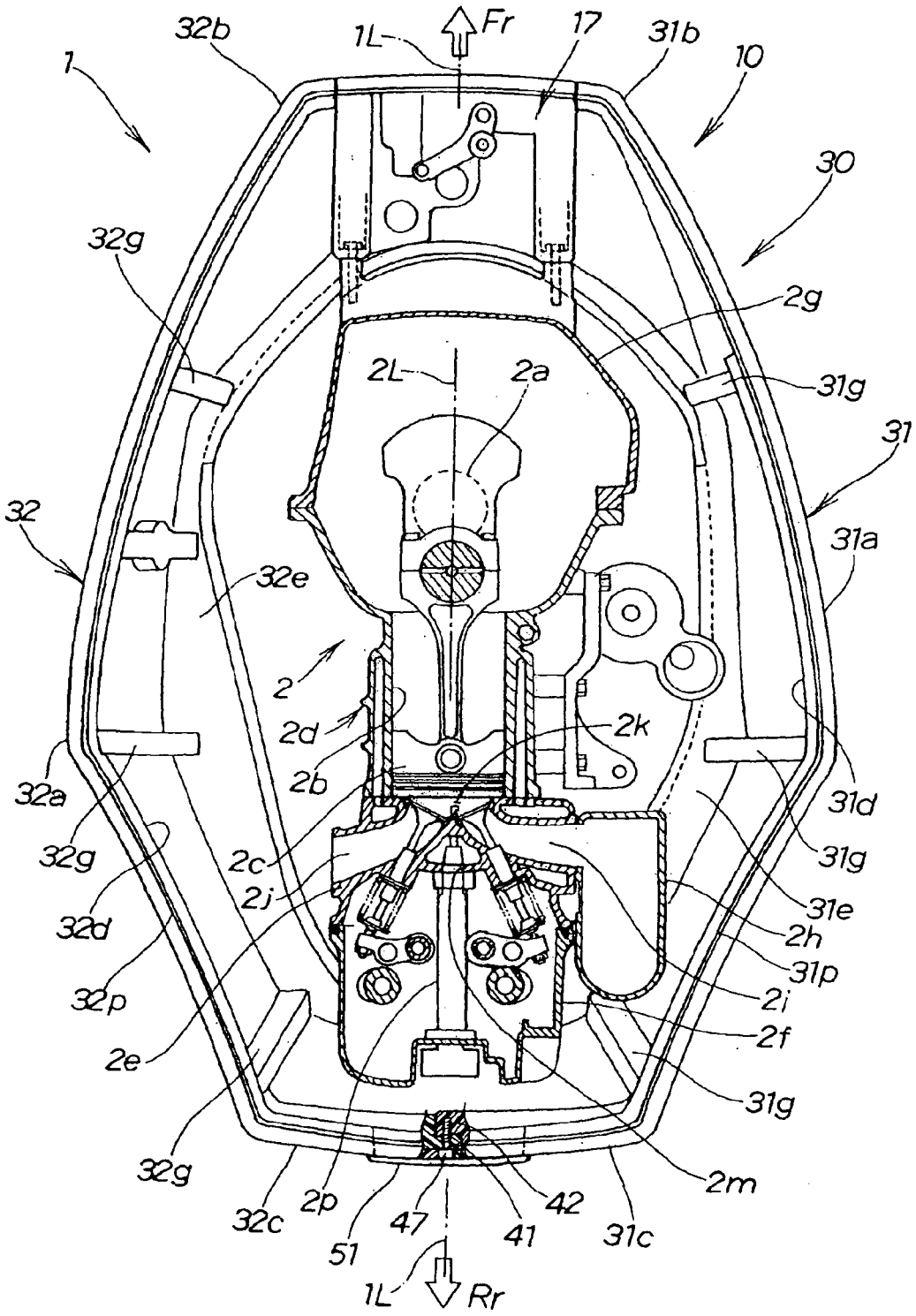
FIG. 2 is an enlarged plan view of the outboard motor with an engine cover removed to show an internal structure of the outboard motor with an engine shown in cross section.

Each cylinder 2*b*, the piston 2*c* received in the cylinder 2*b* and the cylinder head 2*e* together form a combustion chamber 2*k* (FIG. 2). As shown in FIG. 2, the engine is a so-called "double overhead camshaft" engine with two camshafts mounted on the cylinder head 2*e*, one operating the inlet valves (not designated), the other the exhaust valves (not designated). The engine 2 has a spark plug unit 2*p* for each cylinder 2*b*. The spark plug unit 2*p* is located at substantially the center of the combustion chamber 2*k* and equipped with a an integral ignition coil and a plug cap. The spark plug unit 2*p* with integral ignition coil is also called "distributor coil". The spark plug unit 2*p* may be replaced with a unit having a conventional spark plug and a plug cap in combination.

The spark plug unit 2*p* is mounted to an internally threaded hole 2*m* formed in the cylinder head 2*e* along the axis 2L of the cylinder 2*b*. For attachment and detachment of the spark plug unit 2*p* relative to the cylinder head 2*e* at the central portion of the combustion chamber 2*k*, the spark plug unit 2*p* is made accessible from the exterior side of the cover structure 10, as will be described later.

Referring back to FIG. 1, the engine 2 as a whole is supported by a mount case 4 with a pump body 3 disposed therebetween. An oil case 5 is mounted to the underside of the mount case 4 and extends in a vertical downward direction. The mount case 4 has a water jacket 4*a* provided around an exhaust guide 6 connected to an exhaust manifold 2*h* (FIG. 2) extending from the cylinder head 2*e*. The oil case 5 has a downwardly elongated oil pan 5*a* and a downwardly extending exhaust passage 5*b* disposed adjacent the oil pan 5*a*. The exhaust passage 5*b* is connected at an upper end to an exhaust passage 4*b* formed in the mount case 4. With this arrangement, the engine exhaust or emission can be expelled from the combustion chamber 2*k* (FIG. 2) into an extension case 13 successively through the cylinder head 2*e*, exhaust manifold 2*h*, exhaust guide 6, exhaust passage 4*b* of the mount case 4 and exhaust passage 5*b* of the oil case 5. The pump body 3 has a suction tube 3*b* extending downward into the oil pan 5*a* and having an oil strainer 3*a* connected to a lower end of the suction tube 3*b*. The oil strainer 3*a* is located near the bottom of the coil pan 5*a*.

The vertically disposed crankshaft 2*a* of the engine 2 is offset from the center of the outboard motor 1 toward the front side of the outboard motor 1. The crankshaft 2*a* has a lower end portion connected via flywheel (not shown) to an output shaft (not designated). The output shaft extends vertically through the pump body 3 and is connected to an upper end of a vertically disposed drive shaft 7. The drive shaft 7 has an upper end portion rotatably supported by a bearing (not shown) mounted in a through-hole 4*c* of the mount case 4, The drive shaft 7 further extends downward through a vertical space defined between the oil pan 5*a* and a front portion of a peripheral wall 5*c* of the oil case 5. A lower end of the drive shaft 7 is connected via a transmission mechanism 8 to a front end (right end in FIG. 1) of a horizontally disposed output shaft 9*a*. A rear end of the output shaft 9*a* is connected to a screw-propeller 9. With this arrangement, engine power is transmitted from the crankshaft 2*a* to the screw-propeller 9 successively through the drive shaft 7, transmission mechanism 8 and output shaft 9*a*.

The cover structure 10 is constructed to surround and cover the engine 2. More specifically, the cover structure 10 includes a generally cap-shaped top cover 11 open downward and defining an upper part of the engine room 12, and a generally tubular-shaped under cover 30 defining a lower part of the engine room 12. Thus, the top cover 11 covers an upper part of the engine 2, and the under cover 30 covers a lower part of the engine 2. In the illustrated embodiment, the engine lower part covered by the under cover 30 is considerably smaller in volume than the engine upper part covered by the top cover 11. The under cover 30 is constructed not only to define the lower part of the engine room but also to surround the pump body 3, mount case 4 and oil case 5 all disposed below the engine 2. The top cover 11 is also called "engine cover".

The engine room 12 is located at an upper end portion of the outboard motor 1. The mount case 4 forms a bottom wall of the engine room 12. The oil case 5 is mounted to the underside of the mount case 4, as previously discussed. The extension case 13 is connected to a lower end of the oil case 5 and extends downward. A gear case 14 is connected to a lower end of the extension case 13 and houses therein the transmission mechanism 8, a lower end portion of the drive shaft 7 and the output shaft 9*a*. The under cover 30 has a lower part extending downward to the extent that at least a joint portion between the mount case 4 and the oil case 5 is covered by the lower part of the under cover 30.

The outboard motor 1 further has a vertical swivel shaft 15*a* disposed exteriorly of a front end portion of the under cover 30 and extending between a front end portion of the mount case 4 and the extension case 13, and a horizontal tilt shaft 16*a* provided at an upper end portion of a stern bracket 16. The stern bracket 16 has a lower portion connected to a swivel case 15. The swivel case 15 covers the swivel shaft 15*a* and is connected to the mount case 4 and the extension case 13. The outboard motor 1 is mounted to the stern of a boat (not shown) via the stern bracket 16 so that the outboard motor 1 is movable to swing or turn left and right about the vertical swivel shaft 15*a* and also movable to tilt or turn up and down about the horizontal tilt shaft 16*a*. The mount case 4, oil case 5, extension case 13, and gear case 14 together form the case means or structure.

As shown in FIG. 2, the under cover 30 has a generally oblong shape in horizontal cross section with its major axis lying on the longitudinal centerline 1L of the outboard motor 1. The under cover 30 comprises a pair of right and left cover members 31 and 32 joined together at front and rear end portions thereof. The right and left cover members 31, 32 are symmetrical in shape with each other about a vertical plane. The cover members 31, 32 each have a bulged central portion 31*a* swelling in a lateral outward direction of the outboard motor 1, a generally flat front portion 31*b* contiguous to a front end of the central portion 31*a* and facing in the forward direction of the outboard motor 1, and a generally flat rear portion 31*c* contiguous to a rear end of the central portion 31*a* and facing in the rearward direction of the outboard motor 1.

The under cover 30 includes a cable support bracket 17 disposed on a front side of the crankcase 2*g* of the engine 2 and supported between respective upper portions of the front ends 31*a*, 31*b* of the right and left under cover members 31, 32. The cylinder head 2*e* has an exhaust passage 2*i* connected to the exhaust manifold 2*h* disposed on one side of the cylinder head 2*e*, and an intake passage 2*j* connected to an intake manifold (not shown but disposed on the opposite side of the cylinder head 2*e*).

Figure 3:
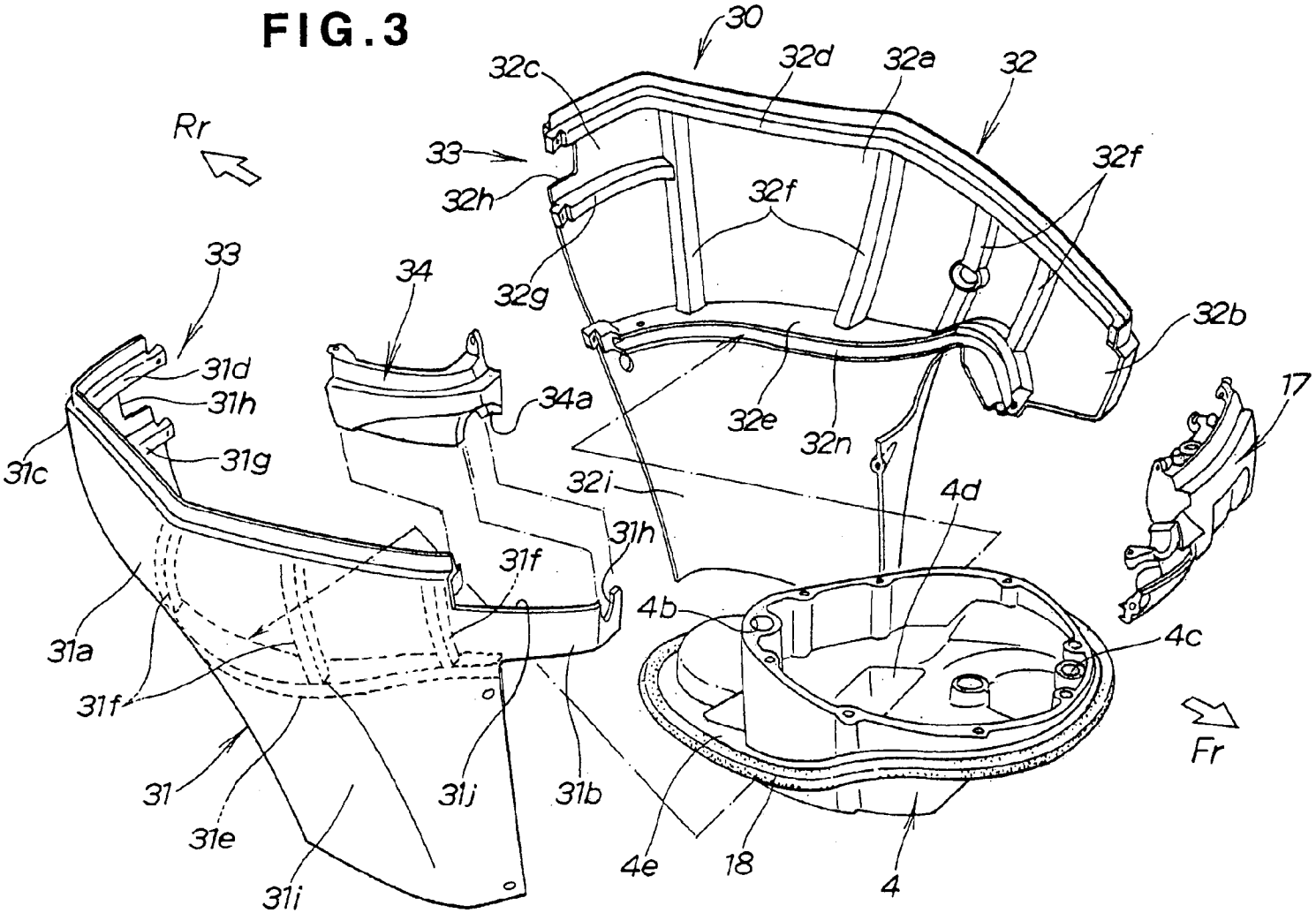
FIG. 3 is an exploded perspective view of an under cover shown in combination with a mount case of the outboard motor.

In FIG. 3 the under cover 30 is shown, in exploded perspective, together with the mount case 4. The right and left cover members 31 and 32 of the under cover 30 are formed by injection molding a synthetic resin material, such as polypropylene, together with glass fiber reinforcement into a mold assembly composed of a core mold member and a cavity mold member movable relative to each other. Thus, the cover members 31, 32 are formed of fiber-reinforced plastics (FRP) and have an outer surface formed by a mold surface of one mold member and an inner surface formed by a mold surface of the other mold member.

The right cover member 31 of the under cover 30 has a generally rectangular cutout recess 31*h* formed in the rear portion 31*c* thereof. The cutout recess 31*h* is vertically spaced from an upper edge of the cover member 31 and extends from a vertical edge 40*a* (FIG. 4) of the rear portion 31*c* in a lateral outward direction (leftward direction in FIG. 3). Similarly, the left cover member 32 of the under cover 30 has a generally rectangular cutout recess 32*h* formed in the rear portion 32*c* thereof. The cutout recess 32*h* is vertically spaced from an upper edge of the cover member 32 by the same distance as the cutout recess 31*h* and extends from a vertical edge 40*b* (FIG. 4) of the rear portion 32*c* in a lateral outward direction (rightward direction in FIG. 3). The cutout recesses 31*h*, 32*h* are formed at the same time when the corresponding cover members 31, 32 are produced by injection molding without requiring a slide core movable in a direction perpendicular to the opening and closing direction of the mold assembly. The mold assembly is relatively simple in construction and can be manufactured at a relatively low cost.

The cover members 31, 32 each have a reinforcement frame 31*d*–31*g*, 32*d*–32*g* attached by, for example, vibration welding to the inner surface of an upper part or half of the cover member 31, 32. The reinforcement frame includes an upper horizontal reinforcement rib 31*d*, 32*d* extending along the upper edge of each respective cover member 31, 32, a lower horizontal reinforcement rib 31*e*, 32*e* extending parallel to the upper horizontal reinforcement rib 31*d*, 32*d* horizontally across a vertical central portion of the cover member 31, 32, and a plurality of vertical reinforcement ribs 31*f*, 32*f* extending between the upper and lower horizontal reinforcement ribs 31*d* and 31*e*, 32*d* and 32*e*, the ribs 31*f*, 32*f* being spaced at proper intervals in the front-and-rear direction of the under cover 30. The reinforcement frame further has an intermediate horizontal reinforcement rib 31*g*, 32*g* disposed immediately below the cutout recess 31*h*, 32*h* and extending between the vertical edge of each respective cover member 31, 32 and a rearmost one of the vertical reinforcement ribs 32*f*, so as to reinforce a peripheral portion of the cutout recess 31*h*, 32*h*. The lower horizontal reinforcement rib 31*e*, 32*e* has a longitudinal groove 31*n* (FIG. 5), 32*n* opening in a lateral inward direction of the cover member 31, 32 for a purpose described later on. The lower horizontal reinforcement rib 31*e*, 32*e* forms a borderline between the upper part and the lower part of each cover member 31, 32.

The reinforcement ribs 31*d*–31*g*, 32*d*–32*g* are formed from a synthetic resin material such as polypropylene and have a hollow tubular cross sectional shape (not shown). Polypropylene exhibits very good moldability and has high tensile strength and great impact resistance. The reinforcement ribs 31*d*–31*g*, 32*d*–32*g* may have an H-shaped cross section. The reinforcement ribs 31*d*–31*g*, 32*d*–32*g* may be formed separately, then assembled together to form a complete reinforcement frame. Alternatively, the reinforcement ribs 31*d*–31*g*, 32*d*–32*g* may be formed as integral parts of a reinforcement frame when the reinforcement frame is produced by molding.

The under cover 30 formed by the right and left cover members 31, 32 is a tube of generally oblong shape in cross section and tapering in a downward direction. The front portion of the under cover 30 is recessed so as to provide a generally inverted L shape configuration having an upper part (not designated) projecting forwardly from a lower part. Stated more specifically, at the recessed front portion 31*b*, 32*b* of each cover member 31, 32, the lower part 31*i*, 32*i* of the cover member 31, 32, which is vertically separated from the upper part by the lower horizontal reinforcement rib 31*e*, 32*e*, is set back from the upper part. In an assembled condition of the under cover 30, the rear portions 31*c*, 32*c* of the respective cover members 31, 32 are held in abutment with each other along the entire height of the under cover 30, whereas the front portions 31*b*, 32*b* of the respective cover members 31, 32 are held in abutment with each other only along the height of the lower parts of the cover members 31, 32.

The right cover member 31 has a rectangular second cutout recess 31*j* formed in the upper edge thereof and extending along the upper part of the front portion 31*b* for receiving therein a separate cover 34. The upper part of the front portion 31*b* has a semi-circular recess 31*k* open upward and formed contiguously with the second cutout recess 31*j*. The separate cover 34 is molded of synthetic resin and has a semi-circular recess 34*a* open downward. The separate cover 34 is received in the second cutout recess 31*j* and attached to the right cover member 31. In this instance, the semi-circular recess 34*a* of the separate cover 34 and the semi-circular recess 31*k* of the cover member 31 jointly form a circular hole in which a grommet (not shown) is fitted for supporting wire cables (not shown).

The mount case 4 has an opening 4*d* for connection with the oil pan 5*a*. The opening 4*d* is formed in a sealed surface surrounded by a vertical outer wall (not designated) in which the exhaust passage 4*b* and the through-hole 4*c* are formed. The mount case 4 also has a flange 4*e* extending radially outward from the outer wall and forming a part of the bottom of the engine room 12 (FIG. 1), and a seal member 18 mounted on and along a peripheral edge of the flange 4*e*. The seal member 18 is formed from an elastic material such as rubber. The mount case 4 and the under cover 30 are assembled together in such a manner that the flange 4*e* of the mount case 4 is received in the longitudinal grooves 31*n* (FIG. 5), 32*n* of the lower horizontal reinforcement ribs 31*e*, 32*e* with the seal member 18 disposed therebetween in a somewhat compressed condition so as to form a hermetic seal between the mount case 4 and the right and left cover members 31, 32 of the under cover 30. The cable support bracket 17, which is disposed in front of the crankcase 28 (FIG. 2) of the engine 2, is disposed between the front portions 31*b*, 32*b* of the right and left cover members 31, 32 and attached to the cover members 31, 32 and the separate cover 34.

Figure 4:
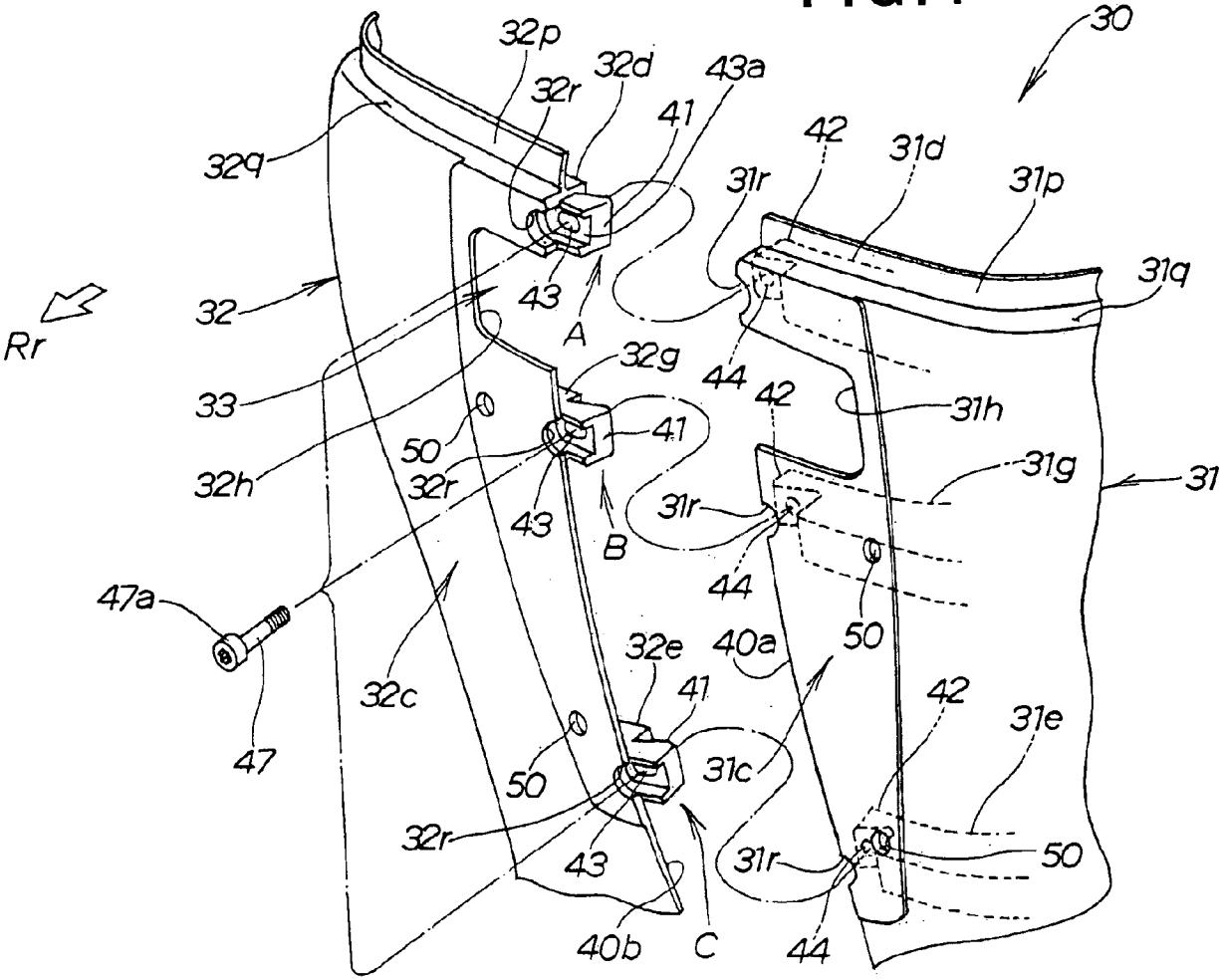
FIG. 4 is an exploded perspective view of a rear portion of the under cover.

FIG. 4 is an exploded perspective view of the upper part of the under cover 30 when viewed from the rearward direction of the outboard motor. As shown in this figure, each of the right and left cover members 31, 32 has a flat top surface 31*q*, 32*q* extending along the upper edge thereof for sealing engagement with a sealing member 45 (FIG. 10) mounted on and along a lower edge 11*a* of the top cover 11, and a vertical guide flange 31*p*, 32*p* projecting upward from the top surface 31*q*, 32*q* for guiding the lower edge 11*a* of the top cover 11 into engagement with the upper edge of the under cover 30. When the top cover 11 and the under cover 30 are assembled together, an inner part of the sealing member 45 is also held in sealing engagement with the guide flange 31*p*, 32*p*.

At the rear end portion of the under cover 30, the right and left cover members 31 and 32 are brought together along vertical edges 40*a*, 40*b* thereof and they are joined together at three joint portions A, B and C arranged at intervals along the vertical edges 40*a*, 40*b*. The vertical edges 40*a*, 40*b* solely form narrow mating surfaces of the cover members 31, 32. The joint portions A, B and C are each formed by a first engagement lug 41 projecting horizontally from the vertical edge 40*b* of the left cover member 32 to a certain extent, and a second engagement lug 42 projecting horizontally from the vertical edge 40*a* of the right cover member 31 to the same extent as the first engagement lug 41.

At the joint portion A, each of the first and second engagement lugs 41, 42 is formed as an integral extension of the upper horizontal reinforcement rib 32*d*, 31*d* of the corresponding cover member 32, 31. Similarly, at the joint portion B, each of the first and second engagement lugs 41, 42 is formed as an integral extension of the intermediate horizontal reinforcement rib 32*g*, 31*g* of the corresponding cover member 32, 31, and at the joint portion C, each of the first and second engagement lugs 41, 42 is formed as an integral extension of the lower horizontal reinforcement rib 32*e*, 31*e* of the corresponding cover member 32, 31. The engagement lugs 41, 42 have a thickness (or a dimension in the front-and-rear direction of the outboard motor) not more than half the thickness of the associated reinforcement ribs 32*d*, 32*g* and 32*e*, 31*d*, 31*g* and 31*e*. Preferably, the thickness of the engagement lugs 41, 42 is determined in view of the strength, rigidity and so on of the engagement lugs 41, 42.

When the opposed vertical edges 40*a*, 40*b* of the right and left cover members 31, 32 are brought together, the engagement lugs 41, 42 at each joint portion A, B, C are fitted together in the front-and-rear direction of the outboard motor. In the illustrated embodiment, mating surfaces 41*a*, 42*a* (FIG. 5) of the engagement lugs 41, 42 are beveled or sloped so that they form a bevel half lap joint (also known as "bevel halved joint"). The engagement lugs 41, 42 are shaped into a reverse taper configuration. The first engagement lug 41, which is disposed on the exterior side of the mating second engagement lug 42 at each joint portion A, B, C, has an oblong hole 43. On the other hand, the second engagement lug 42, which is dispose on the interior side of the mating first engagement lug 41 at each joint portion A, B, C, has a circular hole 44. At each of the joint portions A, B and C, the engagement lugs 41 and 42 are connected together by a screw 47 that is disposed horizontally and threadedly driven into the engagement lugs 41, 42 from the exterior side of the under cover 30. The screw 47 is preferably a self-tapping screw. In order to fully accommodate an enlarged head 47*a* of the screw 47, the oblong hole 43 has a counterbore 43*a* and the vertical edges 40*a*, 40*b* of the cover members 31, 32 have semicircular recesses 31*r*, 32*r* formed at a position corresponding to each respective joint portion A, B, C.

In the illustrated embodiment, the engagement lugs 41, 42 at each joint portion A, B, C are fitted together in the front-and-rear direction (i.e., the longitudinal direction) of the outboard motor so as to form a half lap joint. Though not shown, as for the uppermost joint portion A, the engagement lugs 41 and 42 may be fitted together in the vertical direction of the under cover 30 so that they can be fastened together by a screw disposed vertically. As an alternative, the engagement lugs 41, 42 may be formed into an L-shaped configuration with one arm or stem projecting interiorly and forwardly of the under cover 30. In the latter case, the stems of the L-shaped engagement lugs are brought together and secured by a screw disposed horizontally. So far as the intermediate and lowermost joint portions B and C are concerned, the joint structure shown in the illustrated embodiment (that is, a half lap joint formed by two engagement lugs fitted together in the longitudinal direction of the outboard motor and joined together by a screw disposed horizontally) is advantageous from the esthetic point of view.

The rectangular cutout recess 31*h* formed at the vertical edge 40*a* of the right cover member 31 so as to be elongated in a lateral outward direction (rightward direction in FIG. 4) is located between the upper horizontal reinforcement rib 31*d* and the intermediate horizontal reinforcement rib 31*g* of the right cover member 31. Similarly, the rectangular cutout recess 32*h* formed at the vertical edge 40*b* of the left cover member 32 so as to be elongated in a lateral outward direction (leftward direction in FIG. 4) is located between the upper horizontal reinforcement rib 32*d* and the intermediate horizontal reinforcement rib 32*g* of the left cover member 32. When the respective rear portions 31*c*, 32*c* of the right and left cover members 31 and 32 are joined together along the vertical edges 40*a*, 40*b*, the cutout recess 31*h* in the right cover member 31 and the cutout recess 32*h* in the left cover member 32 are disposed symmetrically with each other about the vertical edges 40*a*, 40*b* and jointly form a horizontally elongated rectangular access opening 33 which intersects the vertical edges 40*a*, 40*b* of the cover members 31, 32. The access opening 33 has a size sufficiently large enough to allow passage of a tool that is used for attachment and detachment of the spark plug unit 2*p* (FIG. 2). The rear portion 31*c*, 32*c* of each cover member 31, 32, has two vertically spaced lid-mounting holes 50, 50 provided for a purpose of mounting a lid 50 (FIG. 6) to the under cover 30.

Since the cutout recess 31*h*, 32*h* is contiguous to the vertical edge (mating surface) 40*a*, 40*b* of each respective cover member 31, 32, a portion of the cover member 31, 32 including the cutout recess 31*h*, 32*h* can be formed without using a slide mold that can be opened and closed in a direction different from the opening and closing direction of the above-mentioned core-and-cavity mold assembly. In the case where the axis 2L (FIG. 2) of each cylinder 2*b* of the engine 2 is offset from, or extends obliquely to, the longitudinal centerline 1L of the outboard motor 1, the axis of the threaded mounting hole 2*m* provided for mounting of the spark plug unit 2*p* is also offset or inclined with respect to the longitudinal centerline 1L in the same manner as the axis 2L of the cylinder 2*b*. In this case, an opening for allowing access to the spark plug unit 2*p* may be formed by a single cutout recess (not shown) formed at the vertical edge 40*a*, 40*b* of only one of the right and left cover members 31, 32 and the vertical edge 40*b*, 40*a* of the other of the right and left cover members 31, 32 held in contact with the recessed vertical edge of the one cover member 31, 32 so as to close an open side of the cutout recess.

Figure 5:
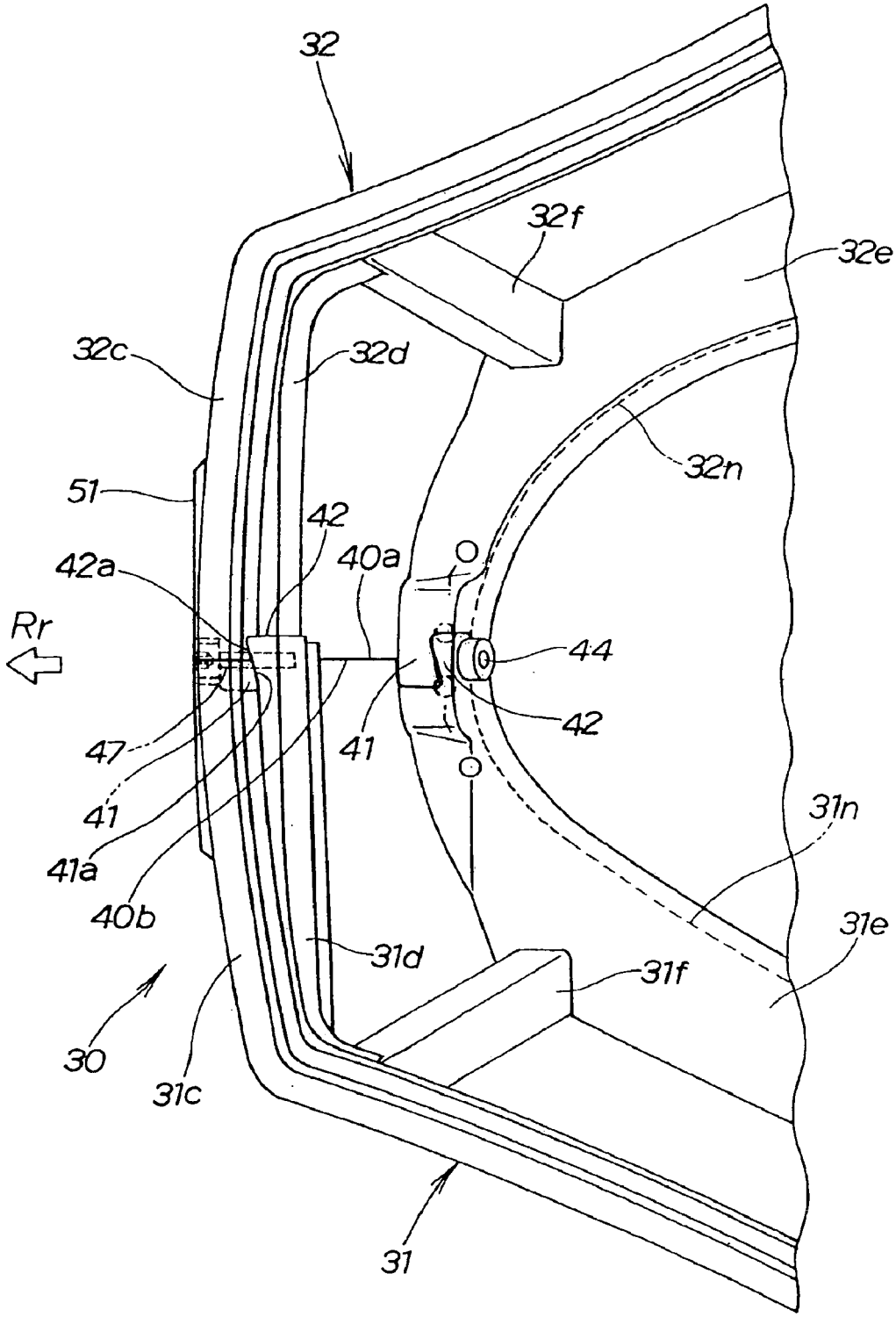
FIG. 5 is a top plan view of the rear portion of the under cover.

FIG. 5 shows in plan view the rear end portion of the under cover 30. As shown in this figure, the rear portions 31*c*, 32*c* of the cover members 31, 32 are brought together along the vertical edges 40*a*, 40*b* and they are firmly connected together by the screws (only one being shown in broken lines) 47 each joining a corresponding one pair of engagement lugs 41, 42. The lid 51 is attached to an outer surface of the rear end portion of the under cover 30 so as to close the opening 33 (FIG. 4).

Figure 6:
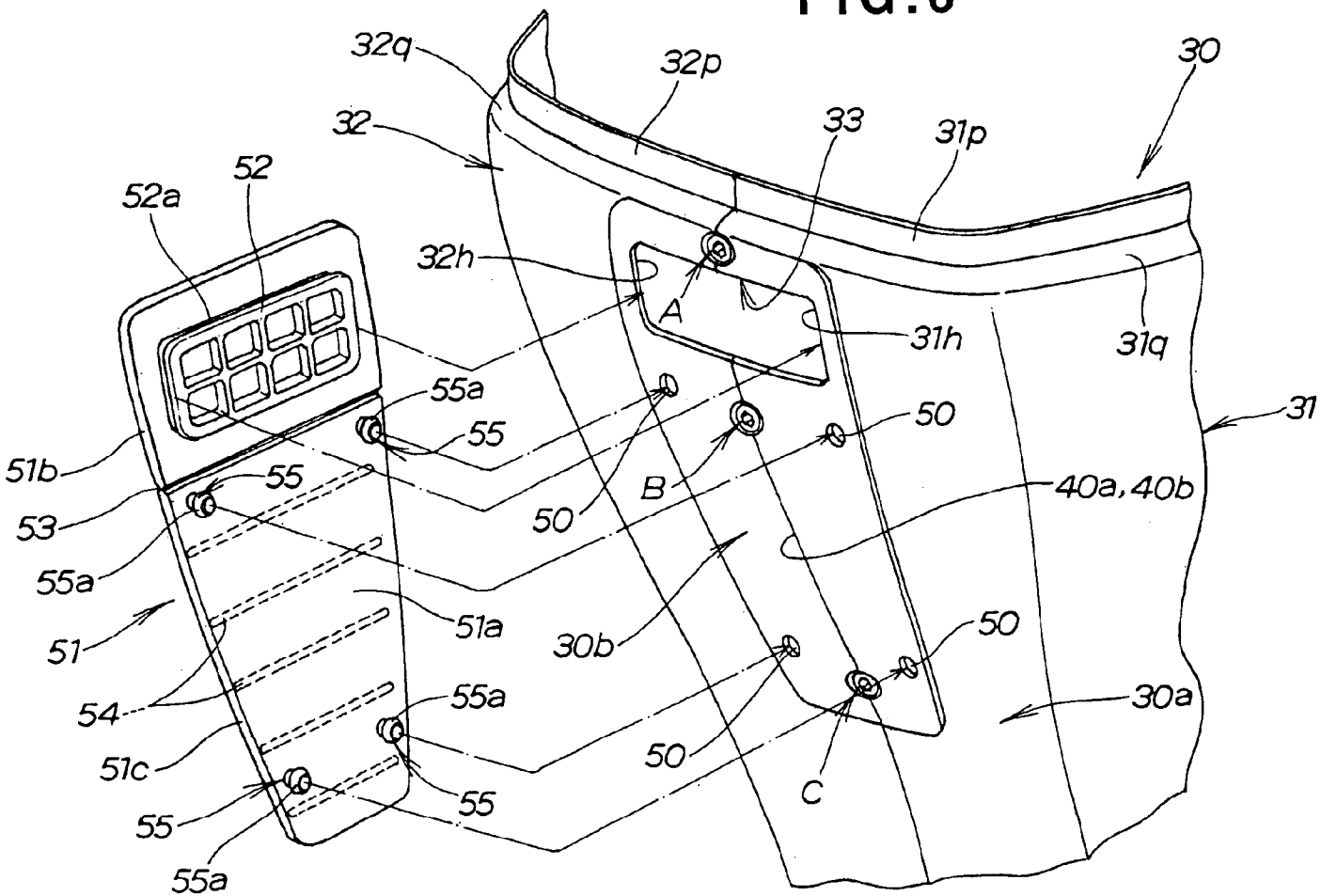
FIG. 6 is a perspective view showing the manner in which a lid is attached to a rear end portion of the under cover.
Figure 7:
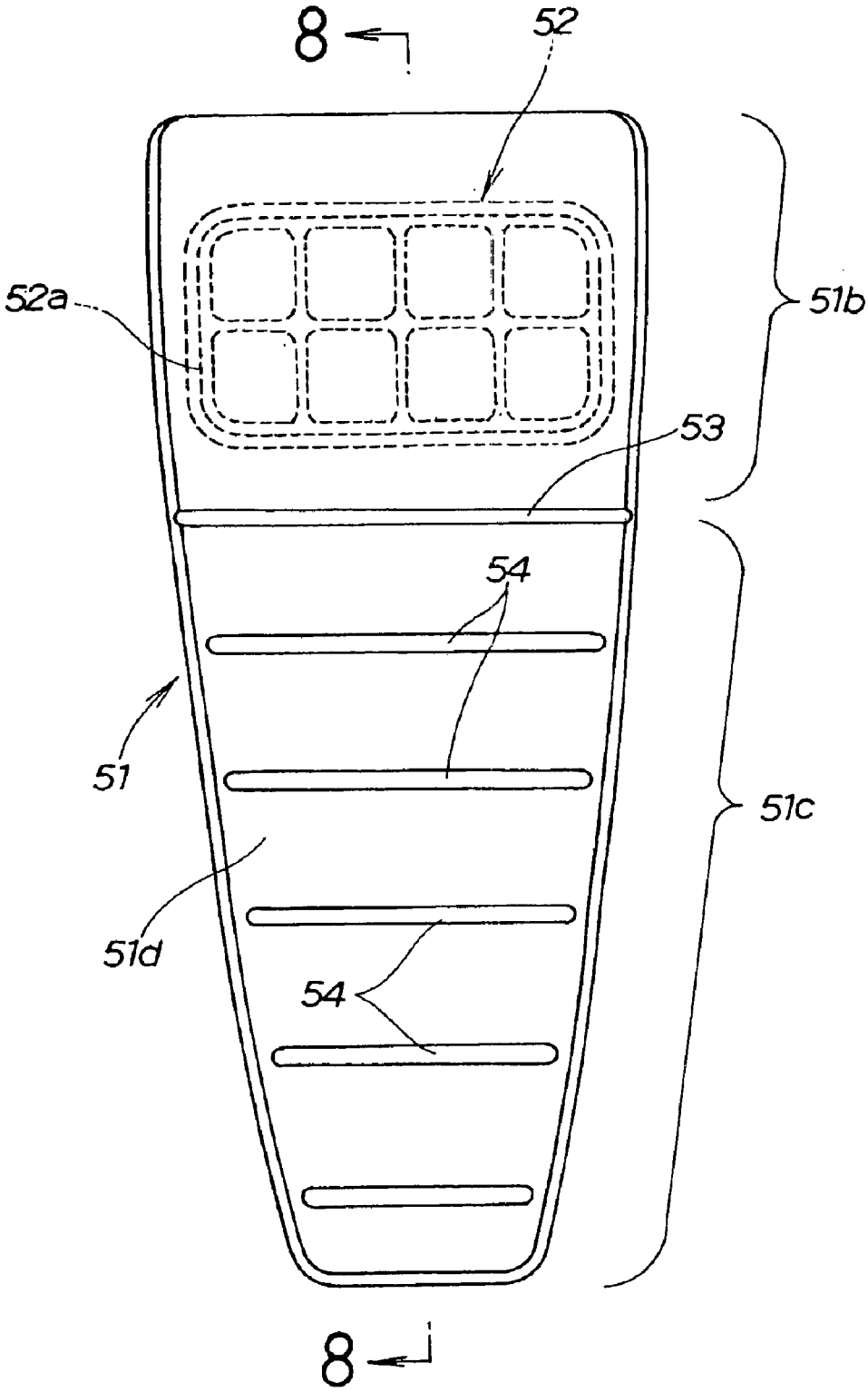
FIG. 7 is a front elevational view of the lid.
Figure 8:
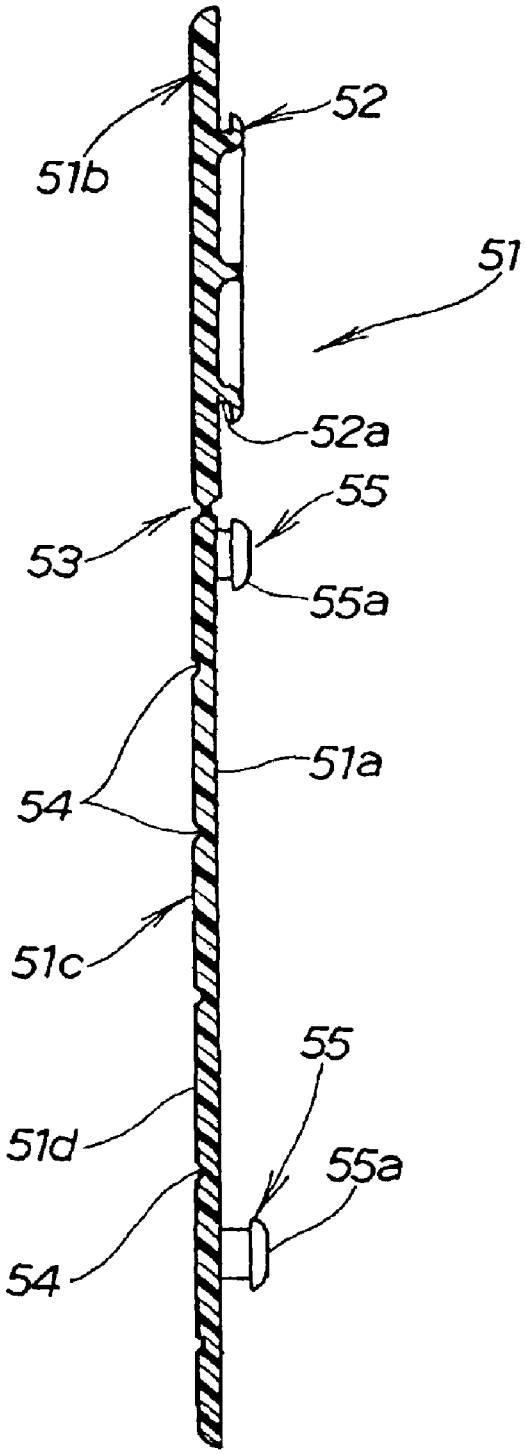
FIG. 8 is a cross-sectional view taken along line 8—8 of FIG. 7.

As best shown in FIG. 6, at the rear end portion 30*a* of the under cover 30, the right and left cover members 31, 32 are connected together by three joint portions A, B and C with the vertical edges (mating surfaces) 40*a*, 40*b* of the cover members 31, 32. The horizontally elongated rectangular opening 33 is formed in an upper part of the rear end portion 30*a* and intersects the vertical edges (mating surfaces) 40*a*, 40*b* of the cover members 31, 32, the opening 33 being located between the uppermost joint portion A and the intermediate joint portion B. The rear end portion 30*a* of the under cover 30 has a flat lid-mounting land or seat 30*b* extending from the upper surfaces 31*q*, 32*q* of the cover members 31, 31 (i.e., the upper edge of the under cover 30) in a vertical downward direction beyond the lowermost joint portion C. The lid-mounting seat 30*b* has a side larger than the width of the rectangular access opening 33 so that the opening 33, the joint portions A–C, and the lid-mounting holes 50 are all formed within an area defined by a peripheral edge of the flat lid-mounting seat 30*b*. The lid-mounting seat 30*b* has a vertically elongated rectangular shape of the substantially the same size as the lid 51.

The lid 51 is a generally vertically elongated rectangular plate-like member made of elastic material such as rubber or soft synthetic resin. The plate-like lid 51 has a flat rear surface 51*a* for intimate face-to-face contact with a flat outer surface of the lid-mounting seat 30*b*. The vertically elongated rectangular lid 51 has an upper part (first part) 51*b* and a lower part (second part) 51*c* connected together by a thin joint portion 53 formed by providing a transverse groove or recess in each of a front surface 51*d* and the rear surface 51*a* of the lid 51. The thin joint portion 53 thus formed serves as a hinge. The upper part 51*b* of the lid 51 has a lattice-like rectangular seal portion 52 formed on the rear surface 51*a* of the lid 51 has a for sealing engagement with a peripheral edge of the rectangular access opening 33 of the under cover 30. The rectangular seal portion 52 has a peripheral groove 52*a* for snugly receiving therein the peripheral edge of the opening 33 to thereby enhance the sealing effect when the seal portion 52 is elastically fitted in the opening 33.

The lower part 51*c* of the lid 51 has a plurality sour in the illustrated embodiment) of locking projections 55 formed on the rear surface 51*a* of the lid 51 for interlocking engagement with the lid-mounting holes 50 of the under cover 30 so as to ensure that the lid 51 is removably attached to the lid-mounting seat 30*b* of the under cover 3. The locking projections 55 have an enlarged head 55*a*. To secure the snap-fit engagement between the locking projections 55 and the lid-mounting holes 50, the enlarged head 55*a* has an outside diameter normally larger than an inside diameter of the lid-mounting holes 50 and is elastically deformable to allow passage of the enlarged head 55 through the engagement hole 50 when the locking projection 55 is forced into or pulled out from the lid-mounting hole 50.

The lower part 51*c* of the lid 51 also has a plurality of ornamental transverse grooves 54 formed in the front surface 51*d* of the lid 51 for a purpose of improving the aesthetic appearance of the lid 51.

When the lid 51 is to be attached to the lid-mounting seat 30*b* of the under cover 30, the lid 51 is placed on the lid-mounting seat 30*b* in such a manner that the locking projections 55 and the seal portion 52 of the lid 51 are in registry with the corresponding lid-mounting holes 50 and the opening 33, respectively, of the lid-mounting seat 30*b*. The lid 51 is then forced or pressed against the lid-mounting seat 30*b* until the rear surface 51*a* of the lid 51 comes in face-to-face contact with a front surface of the lid-mounting seat 30*b*. This forced movement of the lid 51 causes the locking projections 55 to interlock with the lid-mounting holes 50 and, at the same time, causes the seal portion 52 to elastically fit into the opening 33 to the extent that the peripheral edge of the opening 33 is snugly received in the circumferential groove 52*a* of the seal portion 52.

Figure 9:
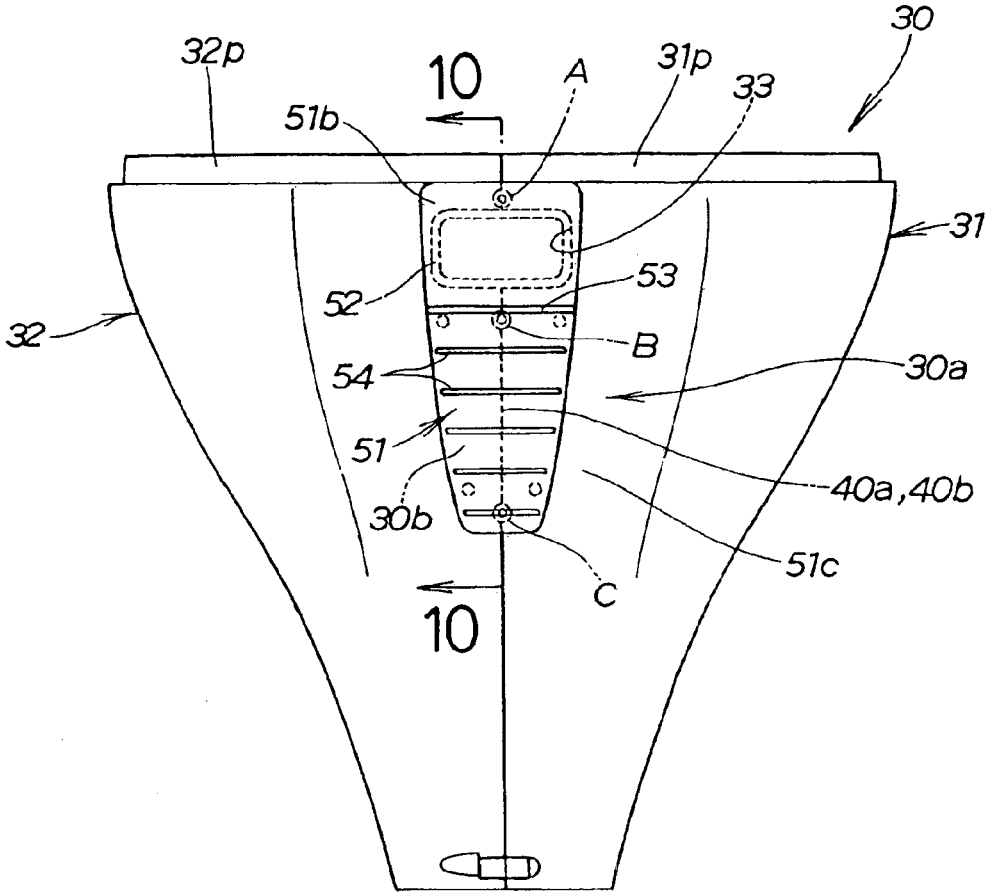
FIG. 9 is a rear view of the under cover with the lid attached thereto.

With the lid 51 thus attached to the lid-mounting seat 30*b*, the opening 33 of the rear end 30*a* of the under cover 30 is closed by the lid 51 and kept watertight by means of the seal portion 52 of the lid 51, as shown in FIG. 9. The lid 51 also covers a portion of the vertical edges (mating surfaces) 40*a*, 40*b* extending longitudinally through the lid-mounting portion 30*b*. By thus attaching the lid 51 to the lid-mounting seat 30*b*, the rear end portion 30*a* of the under cover 30 including the opening 33 is kept watertight. This structure is particularly advantageous in terms of watertightness because the rear end portion 30*a* may be subjected to following sea while the outboard motor is operating to propel the boat.

Figure 10:
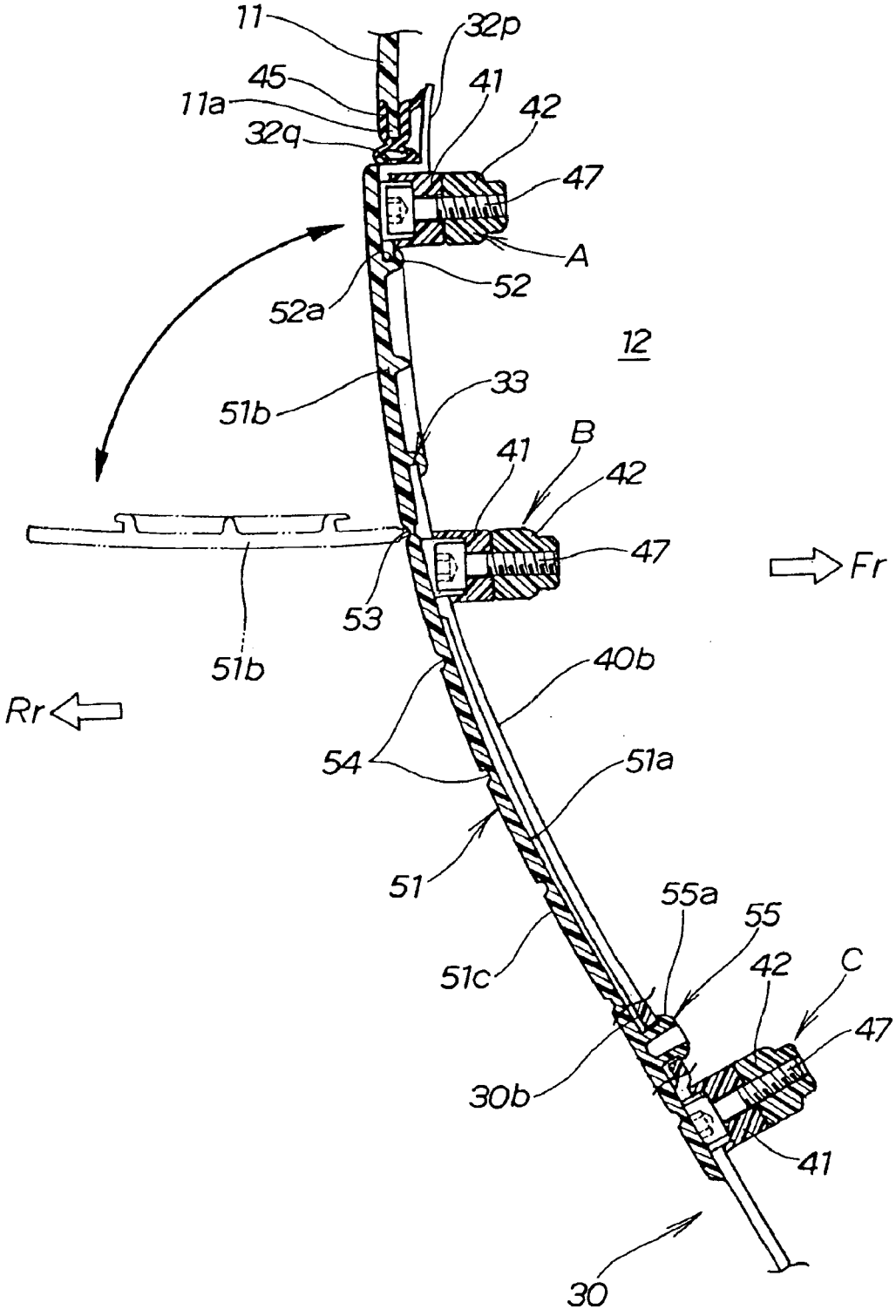
FIG. 10 is an enlarged cross-sectional view taken along line 10—10 of FIG. 9.

As shown in FIG. 10, the opening 33 of the under cover 30 is closed by the upper part 51*b* of the lid 51 and held watertight by means of the seal portion 52 elastically fitted in the opening 33 with the peripheral groove 52*a* snugly or otherwise sealingly receiving therein the peripheral edge of the opening 33. When the opening 33 of the under cover 30 is to be opened for a purpose of maintaining engine parts, such as the spark plug unit 2*p* (FIG. 2), located interiorly (rightward in FIG. 10) of the under cover 30, the upper part 51*b* of the lid 51 is pulled backward (leftward in FIG. 10) away from the under cover 30. This causes the seal portion 52 to disengage from the peripheral edge of the opening 33 whereupon the upper lid part 51*b* is allowed to tilt or turn downward about the joint portion (hinge) 53 and assumes a substantially horizontal recumbent open position as indicated by the phantom lines shown in FIG. 10. During that time, the lower part 51*c* of the lid 51 remains affixed on the lid-mounting seat 30*b* by virtue of the interlocking engagement between the locking projections 55 of the lower lid portion 51*c* and the lid-mounting holes 50 of the lid-mounting seat 30*b*.

When the upper lid part 51*b* is disposed in the phantom-lined recumbent open position of FIG. 10, the opening 33 of the under cover 30 is fully opened. The operator is now allowed to get access through the opening 33 to a rear part of the engine room 12 and achieve the necessary maintenance work, such as replacement or cleaning of spark plugs, using a suitable tool and the like when necessary.

It will be appreciated that the opening 33 of the under cover 30, which is normally closed by the lid 51 attached to the under cover 30, can be opened merely by pulling the upper part 51*b* of the lid 51 backward away from the under cover 30, without requiring detachment of the lid 51 as a whole from the lid-mounting seat 30*b* of the under cover 30.

After completion of the maintenance work, the upper lid part 51*b* is turned upward about the joint portion (hinge) 53. Upward movement of the upper lid part 51*b* causes the seal portion 52 to abut on the peripheral edge of the opening 33. Thereafter, the upper lid part 51*b* is forced or pressed against the lid-mounting seat 30*b* whereby the seal portion 52 on the upper lid part 51*b* elastically fits in the opening 33 with the peripheral edge of the opening 33 snugly received in the circumferential groove 52*a* of the seal portion 52. The opening 33 of the under cover 30 is thus closed by the upper part 51*b* of the lid 51. Opening and closing operation of the upper lid part 51*b* is very easy to achieve, and when the upper lid part 51*b* is in the closing position, the opening 33 is kept watertight as the seal portion 52 of the upper lid part 51*b* is elastically fitted in the opening 33 with the peripheral edge of the opening 33 snugly received in the peripheral groove 52*a* of the seal portion 52.

Figure 11:
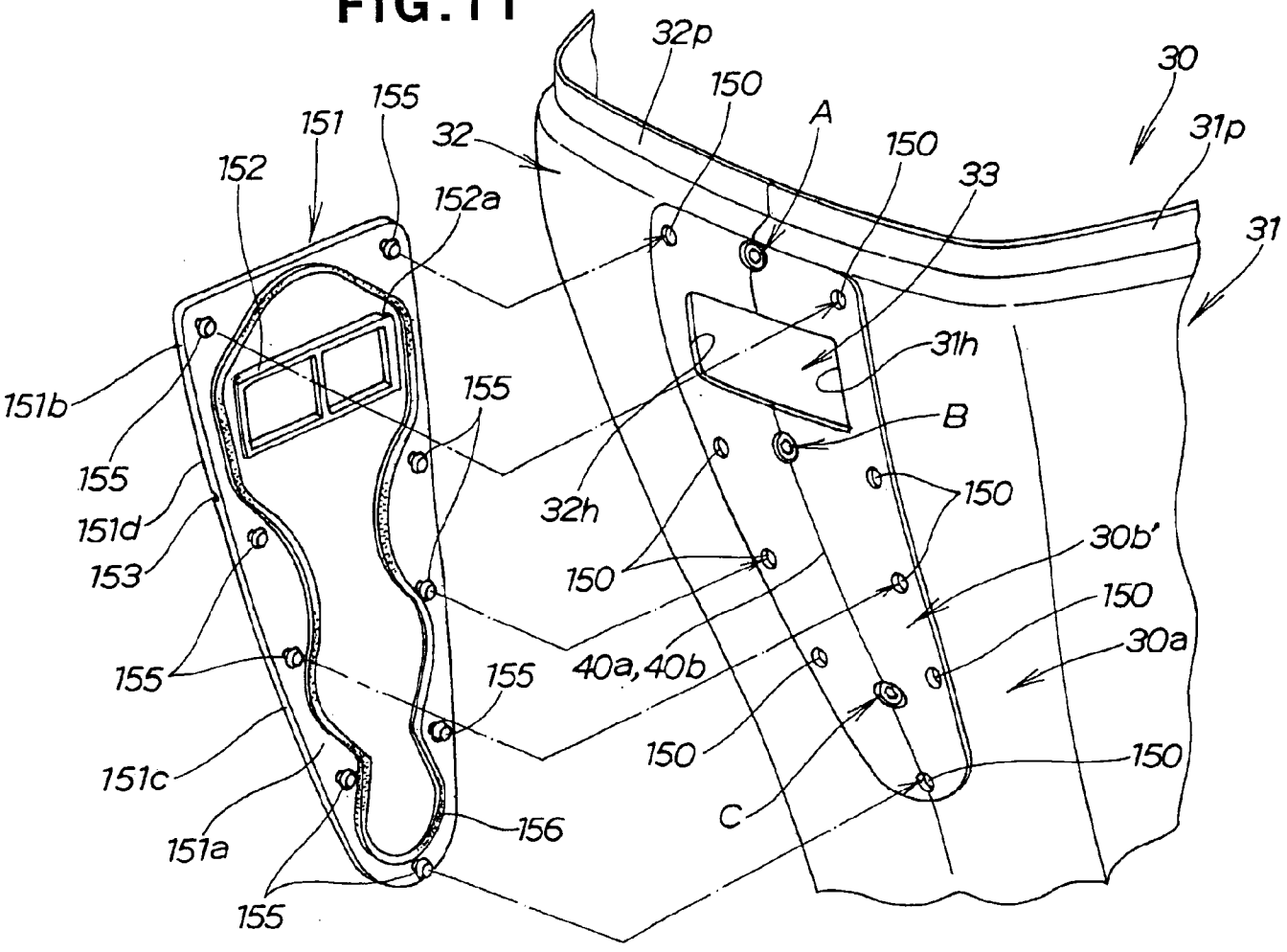
FIG. 11 is a view similar to FIG. 6, but showing a modified form of the lid according to the present invention.

FIG. 11 shows a modified form of the lid-mounting seat of the under cover 30 and a lid 151 used in combination with the modified lid-mounting seat 30*b*'. The modified lid-mounting seat 30*b*' is downwardly elongated as compared to the lid-mounting seat 30*b* of FIG. 6 and has a total of nine lid-mounting holes 150 arranged at intervals along a peripheral edge of the lid-mounting seat 30*b*'. The nine lid-mounting holes 150 includes two lid-mounting holes disposed on left and right sides of the uppermost joint portion A, two lid-mounting holes 150 disposed on left and right sides of the intermediate joint portion B, two lid-mounting holes 150 disposed on left and right sides of the lowermost joint portion C, two lid-mounting holes 150 each disposed intermediately between two of the lid-mounting holes 150 associated with the intermediate and lowermost joint portions B and C at the left side or the right side of these joint portions B, C, and a single lid-mounting hole 150 disposed directly below the lowermost joint portion C.

Figure 12:
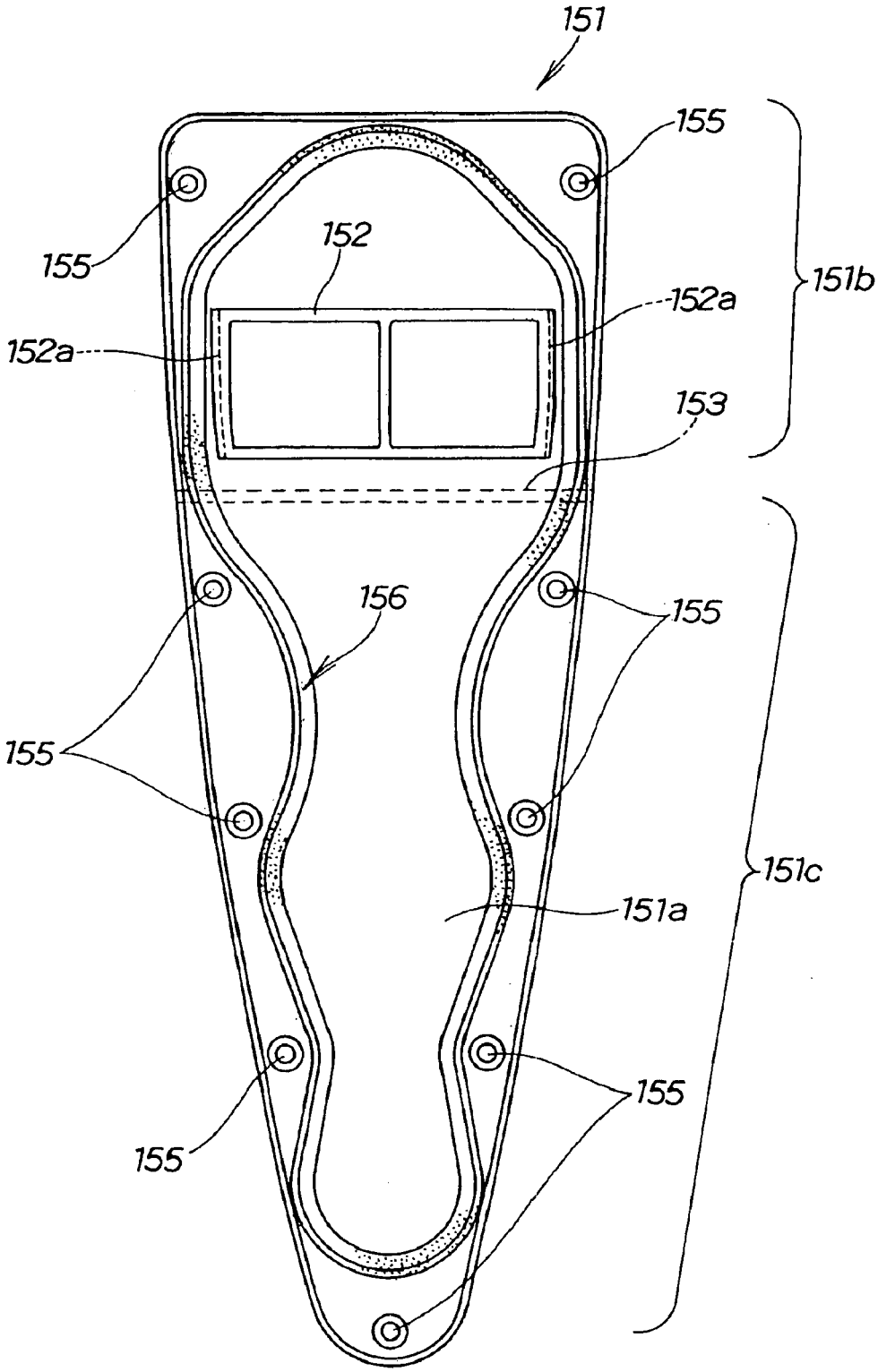
FIG. 12 is a rear elevational view of the lid shown in FIG. 10.

The lid 151, as shown in FIGS. 11 and 12, comprises a vertically elongated plate-like member made of elastic material, such as rubber or soft synthetic resin, and having the same configuration as the lid-mounting seat 30*b*' (FIG. 10). The plate-like lid 151 has a flat rear surface 151*a* for face-to-face contact with a flat front surface of the lid-mounting seat 30*b*'. A plurality of locking projections 155 are formed on the rear surface 151*a* at positions corresponding to the positions of the respective lid-mounting holes 150 of the lid-mounting seat 30*b*'. The locking projections 155 are so configured as to secure snap-fit engagement with the lid-mounting holes 150 when the lid 151 is forced against the lid-mounting seat 30*b*'. The lid 151 also has a seal portion 152 formed on the rear surface 151*a* thereof for fitting engagement with the opening 33 of the under cover 30. The seal portion 152 is in the form of a horizontally elongated rectangular hollow frame and has a peripheral groove 152*a* extending in each of outer vertical frame members (not designated) of the rectangular hollow frame 152.

The lid 151 has an upper part 151*b* and a lower part 151*c* connected by a thin joint portion 153 extending transversely across the width of the lid 151. The joint portion 153 is formed by providing a transverse recess or groove in a front surface 151*d* (FIG. 11) of the lid 151 to thereby reduce the thickness of the lid 151. The thin joint portion 153 thus formed serves as a hinge about which the upper part 151*b* and the lower part 151*c* are turn relative to each other. The lid 151 further has a continuous seal lip 156 formed on the rear surface 151*a* thereof. The seal lip 156 has a closed loop-shaped configuration and is disposed inward of the locking projections 155 and outward of the seal portion 152 and extends along the peripheral edge of the lid 151 without interference with the individual locking projections 155.

The lid 151 of the foregoing construction is attached to the lid-mounting seat 30*b*' of the rear end portion 30*a* of the under cover 30 by virtue of interlocking (snap-fit) engagement between the locking projections 155 of the lid 151 and the lid-mounting holes 150 of the lid-mounting seat 30*b*'. When the lid 151 is attached to the lid-mounting seat 30*b*', the seal portion 152 of the lid 151 is elastically fitted in the opening 33 of the under cover 30 with part of a peripheral edge of the opening 33 is snugly received in the grooves 152*a* of the seal portion 152. The opening 33 of the under cover 30 is thus sealed against water. At the same time, the continuous seal lip 156 is held in sealing contact with the outer surface of the lid-mounting seat 30*b*'. Since the seal lip extends around the opening 33 and the joint portions A, B, C of the longitudinal edges (mating surfaces) 40*a*, 40*b* of the cover members 31, 32, it is possible to increase the degree of waterproofness of the rear end portion 30*a* of the under cover 30 including the opening 33 and the mating surfaces 40*a*, 40*b*.

When the opening 33 of the under cover 30 is to be opened for a purpose of maintaining engine parts, such as the spark plug unit 2*p* (FIG. 2), located interiorly (rightward in FIG. 11) of the under cover 30, the upper part 151*b* of the lid 151 is pulled backward away from the under cover 30 in the same manner as done with respect to the lid 51 shown in FIG. 10. This causes the uppermost two locking projections 155 to disengage from the mating lid-mounting holes 150. As the upper lid part 151*b* is further pulled backward, the seal portion 152 of the lid disengages from the peripheral edge of the opening 33 whereupon the upper lid part 151*b* is allowed to tilt or turn downward about the joint portion (hinge) 153 to such an extent the opening 33 is fully opened. During that time, the lower part 151*c* of the lid 151 remains affixed on the lid-mounting seat 30*b*' by virtue of the interlocking engagement between the locking projections 155 of the lower lid portion 151*c* and the lid-mounting holes 150 of the lid-mounting seat 30*b*'.

The opening 33 of the under cover 30 is thus fully opened. The operator is now allowed to get access through the opening 33 to engine parts so as to achieve the necessary maintenance work, such as replacement or cleaning of spark plugs.

After completion of the maintenance work, the upper lid part 151*b* is turned upward about the joint portion (hinge) 153 and forced against the lid-mounting seat 30*b*' whereby the uppermost two locking projections 155 fit in the mating lid-mounting holes 150, and the seal portion 152 elastically fits in the opening 33 with part of the peripheral edge of the opening 33 snugly received in the grooves 152*a* of the seal portion 152. The seal lip 156 is held in sealing contact with the outer surface of the lid-mounting seat 30*b*'.

Obviously, various minor changes and modifications are possible in the light of the above teaching. It is to be understood that within the scope of the appended claims the present invention may be practiced otherwise than as specifically described.

The present disclosure relates to the subject matter of Japanese Patent Application No. 2002-210154, filed Jul. 18, 2002, the disclosure of which is expressly incorporated herein by reference in its entirety.

What is claimed is:

1. An outboard motor comprising:

an engine; and a cover structure defining an engine room in which the engine is installed, the cover structure comprising a top cover defining an upper part of the engine room and an under cover defining a lower part of the engine room, the top cover and the under cover being detachably connected together along horizontal edges thereof, the under cover comprising a pair of right and left cover members detachably connected together along opposing vertical edges thereof;

an opening formed in at least one of the cover members for allowing access therethrough to the engine installed in the engine room, the opening being vertically spaced from the horizontal edge of the under cover and extending contiguously from the vertical edge of the at least one cover member; and a lid made of elastic material and attached to an outer surface of the under cover so as to close the opening of the under cover, the lid having a first part which covers the opening of the under cover, and a second part integral with the first part and removably connected to the under cover, the first part being elastically bendable relative to the second part so as to open and close the opening of the under cover.

2. An outboard motor according to claim 1, wherein the engine is disposed with a crankshaft disposed vertically and a cylinder disposed horizontally, the engine having a removable spark plug unit associated with the cylinder, the spark plug unit being disposed opposite to the opening of the under cover.

3. An outboard motor according to claim 1, wherein the cover members of the Under cover are formed of a synthetic resin material.

4. An outboard motor according to claim 1, wherein each of the cover members has a cutout recess formed at the vertical edge thereof and forming, together with the cutout recess of the other cover member, the opening of the under cover.

5. An outboard motor according to claim 1, wherein the cover members are connected together by a plurality of joint portions arranged at intervals along the vertical edges of the cover members, each of the joint portions being composed of a first engagement lug projecting horizontally from the vertical edge of one of the cover members, a second engagement lug projecting horizontally from the vertical edge of the other cover member, the first and second engagement lugs being fitted with each other in a front-and-rear direction of the under cover so as to form a half lap joint, and a screw fastener threaded into the first and second engagement lugs to join them together, the joint portions including a first joint portion disposed between the horizontal edge of the under cover and the opening, and a second joint portion disposed below the opening.

6. An outboard motor according to claim 5, wherein the first and second engagement lugs have sloped mating surfaces and are shaped into a reverse taper configuration.

7. An outboard motor according to claim 5, wherein the cover members each have a reinforcement frame disposed on an inner surface thereof, the reinforcement frame including a first horizontal reinforcement rib extending along an upper edge of each respective cover member, a plurality of vertical reinforcement ribs extending vertically downward from the first horizontal reinforcement rib, and a second horizontal reinforcement rib disposed immediately below the opening and extending from the vertical edge of each cover member to one of the vertical reinforcement ribs located near the vertical edge of the cover member, and wherein the first and second engagement lugs of the first joint portion are each formed integrally with the first horizontal reinforcement rib of a corresponding one of the cover members, and the first and second engagement lugs of the second joint portion are each formed integrally with the second horizontal reinforcement rib of a corresponding one of the cover members.

8. An outboard motor according to claim 7, wherein the cover members are formed from a synthetic resin material, and the reinforcement frame is formed from a synthetic resin material and vibration-welded to each of the cover members.

9. An outboard motor according to claim 7, wherein the reinforcement frame further includes a third horizontal reinforcement rib disposed below the second horizontal reinforcement rib and extending parallel to the first horizontal reinforcement rib, the vertical reinforcement ribs extend between the first and third horizontal reinforcement ribs, the joint portions further include a third joint portion disposed below the second joint portion, and the first and second engagement lugs of the third joint portion are each formed integrally with the third horizontal reinforcement rib of a corresponding one of the cover members.

10. An outboard motor according to claim 9, further comprising a mount case on which the engine is mounted, the mount case having a flange, wherein the third horizontal reinforcement rib has a longitudinal groove facing in a lateral inward direction of the under cover and receiving therein a peripheral edge of the flange of the mount case, the mount case forming a bottom wall of the engine room.

11. An outboard motor according to claim 1, wherein the lid further has a thin joint portion interconnecting the first part and the second part and serving as a hinge.

12. An outboard motor according to 1, wherein the first part has a seal portion elastically fitted in the opening of the under cover, and the second part has a plurality of locking projections removably fitted in a corresponding number of lid-mounting holes formed in the under cover.

13. An outboard motor according to claim 12, wherein the seal portion has a groove snugly receiving therein at least part of a peripheral edge of the opening of the under cover.

14. An outboard motor according to claim 12, wherein the lid further has a continuous seal lip extending around the seal portion and sealingly engaging the outer surface of the under cover.

15. An outboard motor according to claim 14, wherein the first part of the lid further has a plurality of locking projections removably fitted in a corresponding number of lid-mounting holes formed in the under cover, the locking projections of the first part and the locking projections of the second part being arranged along a peripheral edge of the lid, the continuous seal lip being disposed inward of the locking projections and outward of the seal portion and extending along the peripheral edge of the lid without interference with the locking projections.

16. An outboard motor according to claim 1, wherein each of the cover members has a cutout recess formed at the vertical edge thereof and forming, together with the cutout recess of the other cover member, the opening of the under cover, and the second part of the lid extends over and along the vertical edges of the cover members.

17. An outboard motor comprising: an engine; and a cover structure defining an engine room in which the engine is disposed, the cover structure having an access opening therein for allowing access therethrough to the engine, and a lid for closing the access opening, the lid having one part removably connected to the cover structure and another part integral with the one part and elastically bendable relative to the one part between open and closed positions so as to open and close the access opening, and the one part of the lid having a plurality of locking projections removably fitted in respective lid-mounting holes formed in the cover structure.

* * * * *